US010689230B2

(12) United States Patent
Kuczek et al.

(10) Patent No.: US 10,689,230 B2
(45) Date of Patent: Jun. 23, 2020

(54) ELEVATOR SYSTEM SUSPENSION MEMBER TERMINATION WITH IMPROVED PRESSURE DISTRIBUTION

(71) Applicant: Otis Elevator Company, Farmington, CT (US)

(72) Inventors: Andrzej Ernest Kuczek, Bristol, CT (US); Joseph C. Rampone, Colchester, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 252 days.

(21) Appl. No.: 15/829,434

(22) Filed: Dec. 1, 2017

(65) Prior Publication Data

US 2018/0155156 A1 Jun. 7, 2018

Related U.S. Application Data

(60) Provisional application No. 62/429,115, filed on Dec. 2, 2016.

(51) Int. Cl.

| | |
|---|---|
| ***B66B 7/08*** | (2006.01) |
| ***B66B 9/00*** | (2006.01) |
| ***B66B 7/06*** | (2006.01) |

(52) U.S. Cl.

CPC ..... *B66B 7/085* (2013.01); *B66B 7/062* (2013.01); *B66B 7/08* (2013.01); *B66B 9/00* (2013.01)

(58) Field of Classification Search

CPC ..... B66B 7/085; B66B 9/00

See application file for complete search history.

(56) References Cited

U.S. PATENT DOCUMENTS 455,033 A * 6/1891 Criswell ..... F16D 65/092 188/244

1,248,991 A 12/1917 Barger (Continued)

FOREIGN PATENT DOCUMENTS

CN 101934962 A 1/2011

CN 102056830 A 5/2011

(Continued)

OTHER PUBLICATIONS

WO2010000330—Machine Translation (Year: 2010).*

(Continued)

*Primary Examiner* — Michael A Riegelman

(74) *Attorney, Agent, or Firm* — Cantor Colburn LLP

(57) ABSTRACT

A termination device for a suspension member of an elevator system includes a housing, and a wedge assembly positioned in the housing. The wedge assembly is interactive with the suspension member to apply a clamping force to the suspension member in response to an axial load acting on the suspension member. The wedge assembly includes a compressible cushion configured to increase uniformity of the clamping force applied to the suspension member by the wedge assembly. An elevator system includes a hoistway, an elevator car located in the hoistway, a suspension member operably connected to the elevator car to suspend and/or drive the elevator car along the hoistway, and a termination device located in the hoistway and operably connected to a suspension member end of the suspension member.

18 Claims, 4 Drawing Sheets

(56) References Cited

U.S. PATENT DOCUMENTS 3,822,442 A * 7/1974 Herbschleb ..... E04C 5/122 24/122.6
5,141,356 A * 8/1992 Chaize ..... E04C 5/122 254/29 A
5,503,257 A * 4/1996 Sugita ..... B66B 5/18 188/250 B
5,636,717 A * 6/1997 Cardenas ..... F16D 69/0416 188/250 D
5,964,320 A * 10/1999 Kato ..... B66B 5/22 187/375
5,979,615 A * 11/1999 Thompson ..... B66B 5/18 188/251 A
6,244,396 B1 * 6/2001 Lumpkin ..... B62L 1/10 188/24.11
6,256,841 B1 * 7/2001 Ericson ..... B66B 7/085 24/136 R
6,371,261 B1 * 4/2002 Thompson ..... B66B 5/22 187/370
6,662,408 B2 * 12/2003 Perez ..... B66B 7/085 187/406
6,733,203 B2 5/2004 Carlsen et al.
6,854,164 B2 2/2005 Bass et al.
6,997,287 B2 * 2/2006 Sasaki ..... B66B 5/22 187/372
7,578,035 B2 8/2009 Dold et al.
7,607,204 B2 10/2009 Ach
7,963,078 B1 * 6/2011 Sorkin ..... E04C 5/122 24/122.3
8,505,173 B2 * 8/2013 Pitts ..... B66B 7/085 24/136 R
9,422,134 B2 8/2016 Ikonen et al.
2006/0054468 A1 * 3/2006 Ach ..... B66B 7/085 198/844.2
2007/0034454 A1 * 2/2007 Dold ..... B66B 7/085 187/411
2007/0240941 A1 * 10/2007 Fischer ..... B66B 5/18 187/359
2008/0279622 A1 * 11/2008 Al-Mayah ..... E04C 5/085 403/374.1
2008/0282512 A1 * 11/2008 Ach ..... B66B 7/085 24/136 R
2008/0296098 A1 * 12/2008 Sato ..... B66B 5/22 187/376
2011/0000746 A1 * 1/2011 Pelto-Huikko ..... B66B 7/062 187/254
2012/0291230 A1 11/2012 Hida
2014/0182975 A1 * 7/2014 Ikonen ..... B66B 5/0031 187/251
2015/0101889 A1 4/2015 Kere et al.
2015/0151948 A1 * 6/2015 Pelto-Huikko ..... B66B 9/00 187/254
2015/0307323 A1 * 10/2015 Zapf ..... B66B 7/062 187/411
2016/0185572 A1 * 6/2016 Lehtinen ..... F16G 11/044 187/411
2016/0207739 A1 * 7/2016 Pelto-Huikko ..... B66B 7/085
2016/0272466 A1 * 9/2016 Helenius ..... B66B 5/0031
2016/0355378 A1 * 12/2016 Lehtinen ..... B66B 7/085
2017/0036891 A1 * 2/2017 Lehtinen ..... B66B 7/085
2017/0189952 A1 * 7/2017 Lampinen ..... B21C 23/00
2017/0217730 A1 * 8/2017 Helenius ..... B66B 7/085
2017/0343160 A1 * 11/2017 Garosshen ..... F17C 1/14
2018/0155156 A1 * 6/2018 Kuczek ..... B66B 9/00
2018/0162697 A1 * 6/2018 Schmidt ..... B66B 7/085
2018/0208434 A1 * 7/2018 Eastman ..... B66B 5/22
2018/0208436 A1 * 7/2018 Schmidt ..... B66B 7/085
2019/0128476 A1 * 5/2019 Kuczek ..... F17C 1/00

FOREIGN PATENT DOCUMENTS

CN 1899942 B 11/2011
CN 202988472 U 6/2013
CN 102992147 B 8/2014
EP 1028911 A1 9/2006
EP 2252807 A1 11/2010
EP 2371753 A1 10/2011
WO 2010000330 A1 1/2010

OTHER PUBLICATIONS

EP2371753—Machine Translation (Year: 2010).*
European Search Report Issued in EP Application No. 17204919.9, dated May 2, 2018, 8 Pages.

* cited by examiner

- PRIOR ART -

- PRIOR ART -

- PRIOR ART -

ELEVATOR SYSTEM SUSPENSION MEMBER TERMINATION WITH IMPROVED PRESSURE DISTRIBUTION

CROSS-REFERENCE TO RELATED APPLICATIONS

This application claims the benefit of 62/429,115, filed Dec. 2, 2016, which is incorporated herein by reference in its entirety.

BACKGROUND

The subject matter disclosed herein relates to elevator systems. More particularly, the present disclosure relates to termination of suspension members of elevator systems.

A typical elevator system includes an elevator car, suspended by one or more suspension members, typically a rope or belt, that moves along a hoistway. The suspension member includes one or more tension members and is routed over one or more sheaves, with one sheave, also known as a drive sheave, operably connected to a machine. The machine drives movement of the elevator car via interaction of the drive sheave with the suspension member. The elevator system further typically includes a counterweight interactive with the suspension member. One or more of the ends of the suspension member are terminated, or retained in the hoistway.

Elevator rope or belt terminations typically rely on the ability to either wrap the rope or belt around a wedge, or the ability to spread the individual wires of the rope and create a knob by placing the spread wires into a socket and potting with a material such as a babbitt or epoxy-based potting compound. These typical methods do not work for suspension members that utilize tension members formed from or including unidirectional fibers in a rigid matrix. In such an arrangement, the tension member will fracture if bent around a typical wedge radius, and the fibers are not able to be spread and bent to be utilized in the potted arrangement. Methods of terminating the suspension member which do not require such deformation occupy significant amounts of space and require a relatively high clamping force to retain the suspension member. Such methods are prone to under-tightening, resulting in slippage of the suspension member.

Thus, belts with such fiber tension members are typically terminated by capture of a substantially straight portion of the belt in a wedge-based termination. Manufacturing tolerances and other factors, however, make it difficult to ensure an even pressure distribution over a captured length of the belt. The belts have limited compressive strength, thus making it important to evenly distribute a clamping pressure to avoid pinching resulting in very high stresses in localized areas.

BRIEF DESCRIPTION

In one embodiment, a termination device for a suspension member of an elevator system includes a housing, and a wedge assembly positioned in the housing. The wedge assembly is interactive with the suspension member to apply a clamping force to the suspension member in response to an axial load acting on the suspension member. The wedge assembly includes a compressible cushion configured to increase uniformity of the clamping force applied to the suspension member by the wedge assembly.

Additionally or alternatively, in this or other embodiments the wedge assembly includes an interface plate configured to abut the suspension member and a wedge abutting an inner housing surface. The compressible cushion is located between the interface plate and the wedge.

Additionally or alternatively, in this or other embodiments a distance between the inner housing surface and the suspension member axis varies along its length.

Additionally or alternatively, in this or other embodiments the wedge and the interface are interlocked along a direction parallel to the suspension member axis.

Additionally or alternatively, in this or other embodiments the cushion includes a shell and a filler material located in the shell.

Additionally or alternatively, in this or other embodiments the filler material is one or more of a polymer, a rubber, a gel, a liquid, or a free flowing powder or granulate material.

Additionally or alternatively, in this or other embodiments the free flowing powder or granulate material is formed from spherical particles of a metal or ceramic material.

Additionally or alternatively, in this or other embodiments the shell is formed from a metal material.

Additionally or alternatively, in this or other embodiments two wedge assemblies are located at opposing sides of the suspension member axis.

In another embodiment, an elevator system includes a hoistway, an elevator car located in the hoistway, a suspension member operably connected to the elevator car to suspend and/or drive the elevator car along the hoistway, and a termination device located in the hoistway and operably connected to a suspension member end of the suspension member. The termination device includes a housing, and a wedge assembly located in the housing. The wedge assembly is interactive with the suspension member to apply a clamping force to the suspension member in response to an axial load acting on the suspension member. The wedge assembly includes a compressible cushion configured to increase uniformity of the clamping force applied to the suspension member by the wedge assembly.

Additionally or alternatively, in this or other embodiments the wedge assembly includes an interface plate configured to abut the suspension member and a wedge abutting an inner housing surface. The compressible cushion is located between the interface plate and the wedge.

Additionally or alternatively, in this or other embodiments a distance between the inner housing surface and the suspension member axis varies along its length.

Additionally or alternatively, in this or other embodiments the wedge and the interface are interlocked along a direction parallel to the suspension member axis.

Additionally or alternatively, in this or other embodiments the cushion includes a shell and a filler material located in the shell.

Additionally or alternatively, in this or other embodiments the filler material is one or more of a polymer, a rubber, a gel, a liquid, or a free flowing powder or granulate material with spherical particles.

Additionally or alternatively, in this or other embodiments the spherical particles are formed from one of a metal or ceramic material.

Additionally or alternatively, in this or other embodiments the shell is formed from a metal material.

Additionally or alternatively, in this or other embodiments two wedge assemblies are located at opposing sides of the suspension member axis.

Additionally or alternatively, in this or other embodiments the suspension member includes a plurality of tension elements extending along a length of the suspension member, each tension element including a plurality of fibers extending along the length of the suspension member bonded into a polymer matrix and a jacket substantially retaining the plurality of tension members.

Additionally or alternatively, in this or other embodiments the plurality of fibers are formed from one or more of carbon, glass, polyester, nylon, or aramid material.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
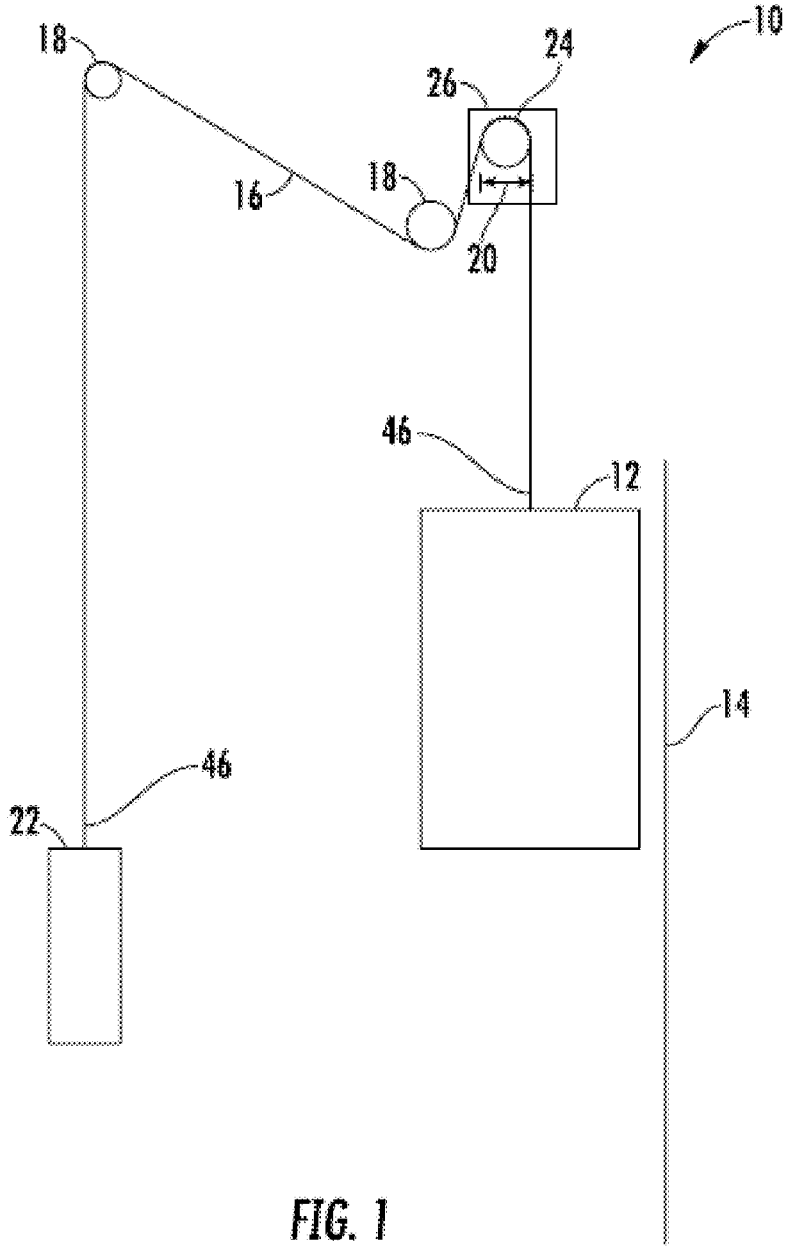
FIG. 1 is a schematic view of an exemplary elevator system.

Shown in FIG. 1, is a schematic view of an exemplary traction elevator system 10. Features of the elevator system 10 that are not required for an understanding of the present invention (such as the guide rails, safeties, etc.) are not discussed herein. The elevator system 10 includes an elevator car 12 operatively suspended or supported in a hoistway 14 with one or more belts 16. The one or more belts 16 interact with one or more sheaves 18 to be routed around various components of the elevator system 10. The one or more belts 16 could also be connected to a counterweight 22, which is used to help balance the elevator system 10 and reduce the difference in belt tension on both sides of the traction sheave during operation.

The sheaves 18 each have a diameter 20, which may be the same or different than the diameters of the other sheaves 18 in the elevator system 10. At least one of the sheaves could be a traction sheave 24. The traction sheave 24 is driven by a machine 26. Movement of drive sheave by the machine 26 drives, moves and/or propels (through traction) the one or more belts 16 that are routed around the traction sheave 24. At least one of the sheaves 18 could be a diverter, deflector or idler sheave. Diverter, deflector or idler sheaves are not driven by a machine 26, but help guide the one or more belts 16 around the various components of the elevator system 10.

In some embodiments, the elevator system 10 could use two or more belts 16 for suspending and/or driving the elevator car 12. In addition, the elevator system 10 could have various configurations such that either both sides of the one or more belts 16 engage the one or more sheaves 18 or only one side of the one or more belts 16 engages the one or more sheaves 18. The embodiment of FIG. 1 shows a 1:1 roping arrangement in which the one or more belts 16 terminate at the car 12 and counterweight 22, while other embodiments may utilize other roping arrangements.

The belts 16 are constructed to have sufficient flexibility when passing over the one or more sheaves 18 to provide low bending stresses, meet belt life requirements and have smooth operation, while being sufficiently strong to be capable of meeting strength requirements for suspending and/or driving the elevator car 12.

Figure 2:
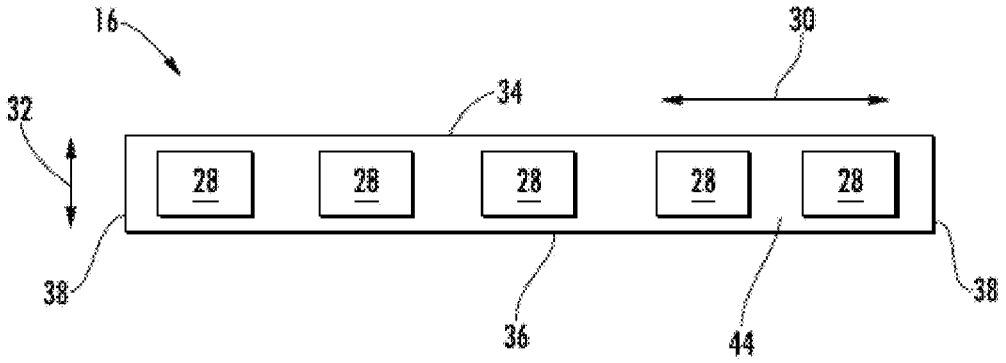
FIG. 2 is a cross-sectional view of an embodiment of a belt for an elevator system.

FIG. 2 provides a cross-sectional schematic of an exemplary belt 16 construction or design. The belt 16 includes a plurality of tension elements 28 extending longitudinally along the belt 16. While the tension elements 28 in the embodiment of FIG. 2 are rectangular in cross-section, it is to be appreciated that other cross-sectional shapes, such as circular, may be utilized in other embodiments. The tension elements 28 may be at least partially encased in a jacket 44, in some embodiments formed from a polymer material such as a thermoplastic polyurethane (TPU). The belt 16 has a belt width 30 and a belt thickness 32, with an aspect ratio of belt width 30 to belt thickness 32 greater than one. The belt 16 defines a traction side 34, which is interactive with the traction sheave 24 and a back side 36 opposite the traction side 34. The belt 16 further defines belt edges 38 extending between the traction side 34 and the back side 36.

Figure 3:
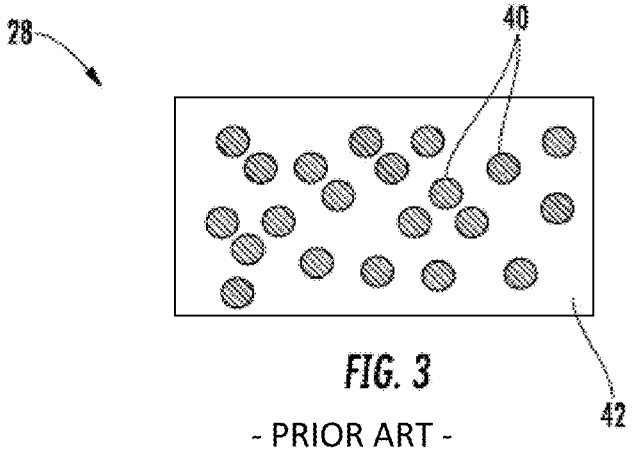
FIG. 3 illustrates an embodiment of a tension element for a belt of an elevator system.

Referring now to FIG. 3, the tension elements 28 include a plurality of fibers 40 bonded to a polymer matrix 42 to form the tension elements 28. The fibers 40 are continuous or discontinuous or combination of continuous and discontinuous over the belt 16 length and, oriented generally such that a fiber 40 length is directed along the belt 16 length. The fibers 40 may be formed of one or more of a number of materials, such as carbon, glass, polyester, nylon, aramid or other polyimide materials. Further, the fibers 40 may be organized into a grouping, such as a spun yarn. The matrix 42 may be formed of, for example a thermoset or thermoplastic material. The tension element 28 is further configured to have a fiber 40 density of 30% to 70% fibers 40 per unit of volume. In some embodiments, the fibers 40 may vary in size, length or circumference and may further be intentionally varied to provide a selected maximum fiber 40 density.

Figure 4:
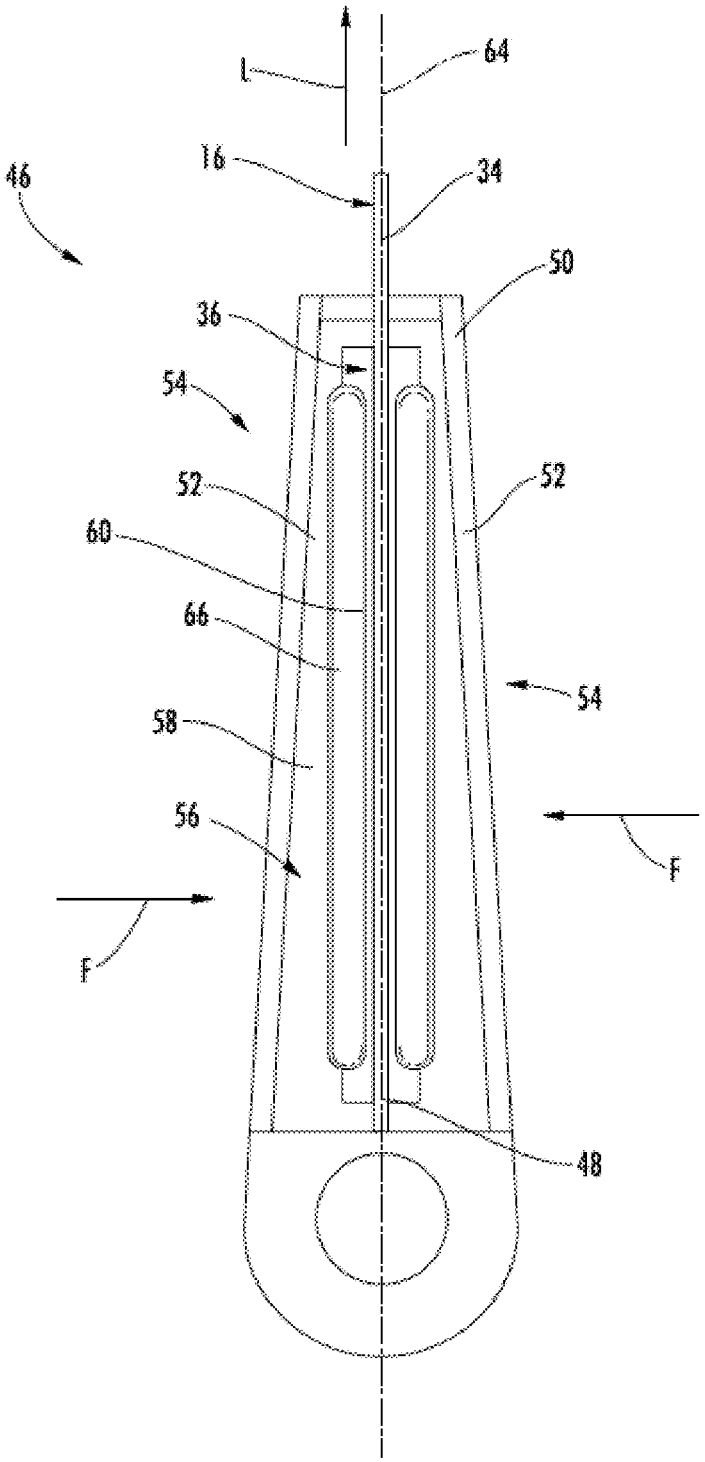
FIG. 4 illustrates a cross-sectional view of a termination for a belt of an elevator system.

Referring now to FIG. 4, an embodiment of a termination 46 is illustrated. A belt end 48 of the belt 16 is installed and retained in the termination 46 at, for example, the elevator car 12 or the counterweight 22, as shown in FIG. 1. The termination 46 includes a housing 50, with a housing inner surface 52 tapering inwardly toward the belt 16 with increasing distance from the belt end 48. Two wedge assemblies 54 are installed in the housing 50 between the housing inner surface 52 and the belt 16. A first wedge assembly 54 is installed between the housing inner surface 52 and the traction surface 34 of the belt 16, with the wedge assembly 54 interactive with the traction surface 34. Additionally, a second wedge assembly 54 is installed between the housing inner surface 52 and the back surface 36 of the belt 16 and is interactive with the back surface 36. Edge wedge assembly 54 includes a wedge 56 including a wedge outer surface 58 abutting the housing inner surface 52 and having a taper complimentary with the housing inner surface 52. The wedge assembly 54 further includes an interface plate 60 abutting the belt 16.

Figure 5:
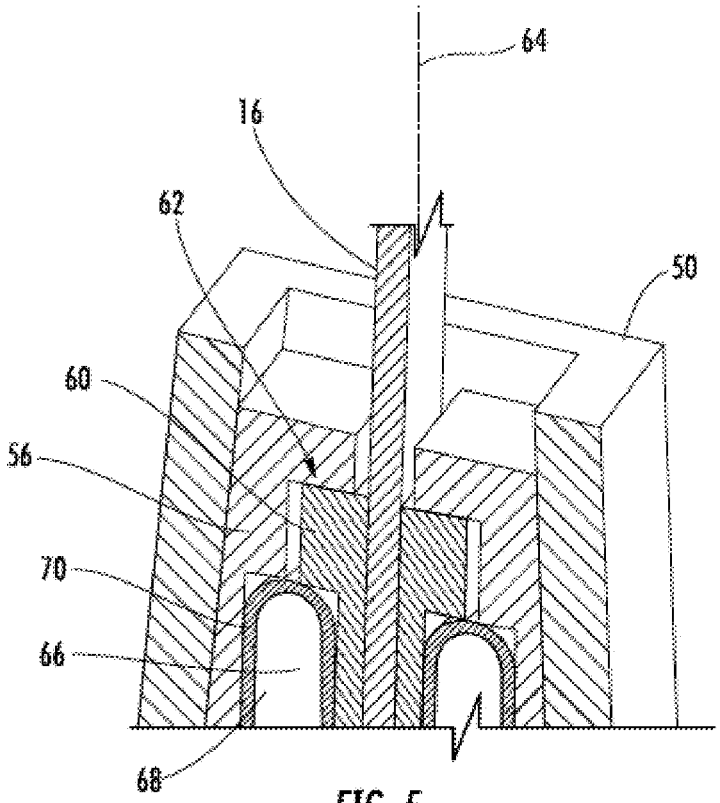
FIG. 5 is a partial cross-sectional view of the termination.

Referring to FIG. 5, the wedge 56 and the interface plate 60 are interlocked by, for example an overlapping of a wedge tab 62 over the interface plate 60. When a load L is applied along a belt axis 64, the interface plate 60 and the wedge 56 travel along the belt axis 64, and because of the taper of the housing inner surface 52 and the complimentary wedge outer surface 58, move inwardly toward the belt 16, thus applying a clamping force F to the belt 16 to retain the belt 16 at the termination 46. As the load L increases, the clamping force F similarly increases.

Referring again to FIG. 4, to improve uniformity of clamping force distribution across the belt 16 traction surface 34 and/or the back surface 36, a cushion 66 is located between the interface plate 60 and the wedge 56. As best shown in FIG. 5, the cushion 66 is a sealed, compressible element, containing a filler material 68, which may be a soft polymer, rubber or gel material, or in other embodiment s a liquid such as hydraulic fluid or oil. Alternatively another flowable material such as a free flowing powder or granulates with spherical particles of, for example, a metal or ceramic material may be utilized. The filler material 68 is contained in a shell 70, which in some embodiments is formed from a thin-walled metal material. The shell 70 is formed and configured to allow the cushion 66 to be compressible and yet prevent creep of the cushion 66 under the clamping force F.

The cushion 66 is located between the interface plate 60 and the wedge 56 to improve uniformity of pressure distribution applied to the belt 16, counteracting any potential non-uniformities due to manufacturing variations in the termination 46 components or in the belt 16, as well as counteracting deformation of the termination 46 components due to the applied load L. Use of the cushion 66 reduces localized high stresses on the belt 16 to reduce a risk of damage to the tension elements 28 of the belt 16, and reduces the occurrences of high shear stress areas thereby reducing damage risk to the jacket 44 material.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A termination device for a suspension member of an elevator system comprising:
- a housing; and
- a wedge assembly disposed in the housing, the wedge assembly interactive with the suspension member to apply a clamping force to the suspension member in response to an axial load acting on the suspension member, the wedge assembly including a compressible cushion configured to increase uniformity of the clamping force applied to the suspension member by the wedge assembly;
- wherein the wedge assembly includes:
  - an interface plate configured to abut the suspension member; and
  - a wedge abutting an inner housing surface;
  - wherein the compressible cushion is disposed between the interface plate and the wedge, the compressible cushion abutting both the interface plate and the wedge.

2. The termination device of claim 1, wherein a distance between the inner housing surface and the suspension member axis varies along its length.

3. The termination device of claim 1, wherein the wedge and the interface plate are interlocked along a direction parallel to the suspension member axis.

4. The termination device of claim 1, wherein the cushion includes:
- a shell; and
- a filler material disposed in the shell.

5. The termination device of claim 4, wherein the filler material is one or more of a polymer, a rubber, a gel, a liquid, or a free flowing powder or granulate material.

6. The elevator system of claim 5, wherein the free flowing powder or granulate material is formed from spherical particles of a metal or ceramic material.

7. The termination device of claim 4, wherein the shell is formed from a metal material.

8. The termination device of claim 1, comprising two wedge assemblies disposed at opposing sides of the suspension member axis.

9. An elevator system comprising:
- a hoistway;
- an elevator car disposed in the hoistway;
- a suspension member operably connected to the elevator car to suspend and/or drive the elevator car along the hoistway; and
- a termination device disposed in the hoistway and operably connected to a suspension member end of the suspension member, the termination device including:
  - a housing; and
  - a wedge assembly disposed in the housing, the wedge assembly interactive with the suspension member to apply a clamping force to the suspension member in response to an axial load acting on the suspension member, the wedge assembly including a compressible cushion configured to increase uniformity of the clamping force applied to the suspension member by the wedge assembly;
  - wherein the wedge assembly includes:
    - an interface plate configured to abut the suspension member; and
    - a wedge abutting an inner housing surface;
    - wherein the compressible cushion is disposed between the interface plate and the wedge, the compressible cushion abutting both the interface plate and the wedge.

10. The elevator system of claim 9, wherein a distance between the inner housing surface and the suspension member axis varies along its length.

11. The elevator system of claim 9, wherein the wedge and the interface plate are interlocked along a direction parallel to the suspension member axis.

12. The elevator system of claim 9, wherein the cushion includes:
- a shell; and
- a filler material disposed in the shell.

13. The elevator system of claim 12, wherein the filler material is one or more of a polymer, a rubber, a gel, a liquid, or a free flowing powder or granulate material with spherical particles.

14. The elevator system of claim 13, wherein the spherical particles are formed from one of a metal or ceramic material.

15. The elevator system of claim 12, wherein the shell is formed from a metal material.

16. The elevator system of claim 9, comprising two wedge assemblies disposed at opposing sides of the suspension member axis.

17. The elevator system of claim 9, wherein the suspension member includes:
- a plurality of tension elements extending along a length of the suspension member, each tension element including a plurality of fibers extending along the length of the suspension member bonded into a polymer matrix; and
- a jacket substantially retaining the plurality of tension members.

18. The elevator system of claim 17, wherein the plurality of fibers are formed from one or more of carbon, glass, polyester, nylon, or aramid material.

* * * * *